US005941052A

United States Patent [19]

Evangelisti

[11] Patent Number: 5,941,052

[45] Date of Patent: Aug. 24, 1999

[54] METHOD AND APPARATUS FOR AUTOMATICALLY PACKAGING A FOOD OR NON-FOOD PRODUCT

[75] Inventor: Riccardo Evangelisti, Milan, Italy

[73] Assignee: Cryovac, Inc., Duncan, S.C.

[21] Appl. No.: 08/930,772

[22] PCT Filed: Apr. 5, 1996

[86] PCT No.: PCT/EP96/01505

§ 371 Date: Dec. 12, 1997

§ 102(e) Date: Dec. 12, 1997

[87] PCT Pub. No.: WO96/31397

PCT Pub. Date: Oct. 10, 1996

[30] Foreign Application Priority Data

Apr. 6, 1995 [IT] Italy ..... MI95A0689

[51] Int. Cl.[6] ..... B65B 3/302; B65B 9/06

[52] U.S. Cl. ..... 53/433; 53/450; 53/455; 53/511; 53/550; 53/562; 53/371.6; 53/75

[58] Field of Search ..... 53/433, 434, 455, 53/450, 550, 562, 557, 442, 511, 512, 371.6, 75

[56] References Cited

U.S. PATENT DOCUMENTS

| | | | |
|---|---|---|---|
| 3,237,371 | 3/1966 | Gerlach . | |
| 3,295,289 | 1/1967 | Critchell | 53/551 X |
| 3,339,337 | 9/1967 | Rapp et al. | 53/562 |
| 4,141,196 | 2/1979 | Blanding | 53/550 |
| 4,185,443 | 1/1980 | Budzyn | 53/550 |
| 4,205,504 | 6/1980 | Gregoire et al. | 53/562 X |
| 4,219,988 | 9/1980 | Shanklin et al. | 53/550 |
| 4,494,362 | 1/1985 | Koch | 53/550 |
| 4,537,016 | 8/1985 | Shanklin et al. | 53/493 |
| 4,624,100 | 11/1986 | Lesch | 53/550 |
| 4,924,659 | 5/1990 | Watanabe | 53/550 |
| 4,939,889 | 7/1990 | Watanabe | 53/550 X |
| 5,062,252 | 11/1991 | Kupcikevicius | 53/434 |
| 5,165,221 | 11/1992 | Udelson et al. | 53/550 |
| 5,329,745 | 7/1994 | Suga | 53/550 X |
| 5,337,542 | 8/1994 | Omori | 53/550 |
| 5,341,623 | 8/1994 | Siegel | 53/550 X |
| 5,371,999 | 12/1994 | Hansen et al. | 53/450 |
| 5,618,252 | 4/1997 | Melville | 493/22 |
| 5,816,990 | 10/1997 | Melville | 493/22 |

FOREIGN PATENT DOCUMENTS

| | | |
|---|---|---|
| 0 509 666 A2 | 3/1992 | European Pat. Off. . |
| 0 405 718 | 3/1993 | European Pat. Off. . |
| 2 266 509 | 3/1993 | United Kingdom . |
| WO 93/01091 | 1/1993 | WIPO . |

*Primary Examiner*—John Sipos
*Attorney, Agent, or Firm*—Mark B. Quatt

[57] ABSTRACT

A method of packaging includes unwinding a center-folded film from a roller, the center-folded film having a first web and a second web; forming a recess between the first and second film webs; feeding a plurality of products into the thus formed recess, as the film advances, the products spaced apart from each other, and the products having a first and second transverse side; sealing and severing the advancing film between each product to be packaged along each of the two transverse sides of each product so as to form a plurality of bags with one open mouth on a front side of each bag, wherein each bag encloses a respective product; and sealing or clipping each open bag mouth. An apparatus is also disclosed.

17 Claims, 3 Drawing Sheets

METHOD AND APPARATUS FOR AUTOMATICALLY PACKAGING A FOOD OR NON-FOOD PRODUCT

FIELD OF THE INVENTION

This invention relates to a method and an apparatus for packaging a food or non-food product by means of a mono- or multi-layer thermoplastic film.

BACKGROUND OF THE INVENTION

A typical conventional method for producing an air-free package uses either an end-seal or side-seal pre-formed bag made of a thermoplastic material.

In both cases, a product to be packaged is loaded into the pre-formed bag, the bag is evacuated in a vacuum chamber, and the open mouth of the vacuumized bag is then sealed or clipped.

Very often this method is used in conjunction with a pre-formed bag made of a heat-shrinkable thermoplastic material. After sealing or clipping of the vacuumized bag, the bag is heated while traveling through a shrink tunnel. The bag thus shrinks around the packaged product.

In the case of a food product, the thus obtained air-free package increases the shelf-life of the packaged product.

This method, however, lacks flexibility.

A first reason is that only some standard sizes of bags are available that do not fit the size of every product to be packaged.

Secondly, the packaging machine has to be set on the size of the bag which is being used. When a change in size is required, the packaging machine has to be shut-down, reset, and restarted.

Thirdly, high packaging speed cannot be achieved even if the final steps of the packaging process (i.e. vacuumizing, sealing, and shrinking) are performed in a revolving machine equipped with a plurality of vacuum and sealing chambers. The earlier steps (i.e., opening of the bag mouth and loading of the product) cannot be sped up without risking an unacceptable increase in rejects.

Finally, the storage of pre-formed bags having many different sizes is costly.

In order to overcome these drawbacks it has been proposed, in U.S. Pat. Nos. 3,237,371, 4,141,196, and 4,537,016, to form a bag in line from film webs which are continuously shaped into a tubular form. However, this also lacks flexibility. Although the width of the package can be adjusted depending on the width of the product to be packaged by means of suitable sensors that provide a proper input to a microprocessor, the diameter of the tube (i.e., the length of the package) cannot be changed in accordance with the length of the product itself.

It is therefore desirable to provide a method and apparatus capable of automatically forming packages, including air-free packages, from a continuous thermoplastic film wherein any single resulting package, including a tight-skinned package, can have a different length and/or width without requiring any resetting of the apparatus.

SUMMARY OF THE INVENTION

In a first aspect, a method of packaging comprises:

(a) unwinding a center-folded film from a roller, the center-folded film having a first web and a second web;

(b) forming a recess between the first and second film webs;

(c) feeding a plurality of products into the thus formed recess, as the film advances, the products spaced apart from each other, and the products each having a first and second transverse side;

(d) sealing and severing the advancing film between each product to be packaged along each of the two transverse sides of each product so as to form a plurality of bags with one open mouth on a front side of each bag, wherein each bag encloses a respective product; and (e) sealing or clipping each open bag mouth.

In a second aspect, an apparatus comprises:

(a) a roller on which a center-folded film is mounted, the center-folded film having a first web and a second web;

(b) means for guiding the two webs of said center-folded film and forming a recess capable of enclosing a product;

(c) means for advancing the film in a preselected direction while feeding a plurality of products into the recess between the film webs, the products spaced apart from each other, and the products having a first and second transverse side;

(d) means for sealing the film along the two transverse sides of each product, said means movable vertically and horizontally; and (e) means for severing the film so as to form a plurality of bags with one open mouth on a front side of each bag, wherein each bag encloses a respective product.

Definitions The terms "rear side", "front side" and "transverse side" of the product to be packaged refer to the location of each single product with respect to the center-folding of the film. The side of each product close to the centerfold of the film is referred to as "rear side"; the side opposite the rear side is the front side; and remaining two sides are the first and second transverse sides. However, the products to be packaged can be fed randomly, so that the side of a product which is referred to as the "rear side" may change randomly, product by product, even when the products are otherwise the same.

As used herein the term "vacuum" also includes partial vacuum as it is well understood in the art and the term "vacuumizing" or "evacuating" refers to the removal of any undesired amount of gas (e.g., air) from the vacuum chamber and as a consequence thereof from the bag.

As used herein, the term "heat-shrinkable film" means any of those films of thermoplastic material that, during production, have been stretched and oriented at a temperature below the melting temperature of at least one of the resins used in the film so that when they are used in packaging, they shrink tightly around the package contents upon re-warming to a temperature close to the orientation temperature.

More specifically, a "heat-shrinkable film" is a film having a free shrink of at least 5%, preferably at least 10%, in at least one direction at 90° C. when evaluated according to ASTM method D-2732.

BRIEF DESCRIPTION OF THE DRAWINGS

Features and advantages of the invention will now be illustrated with reference to an embodiment presented as a non-limiting example in the enclosed figures, wherein.

DETAILED DESCRIPTION OF THE INVENTION

Figure 1:
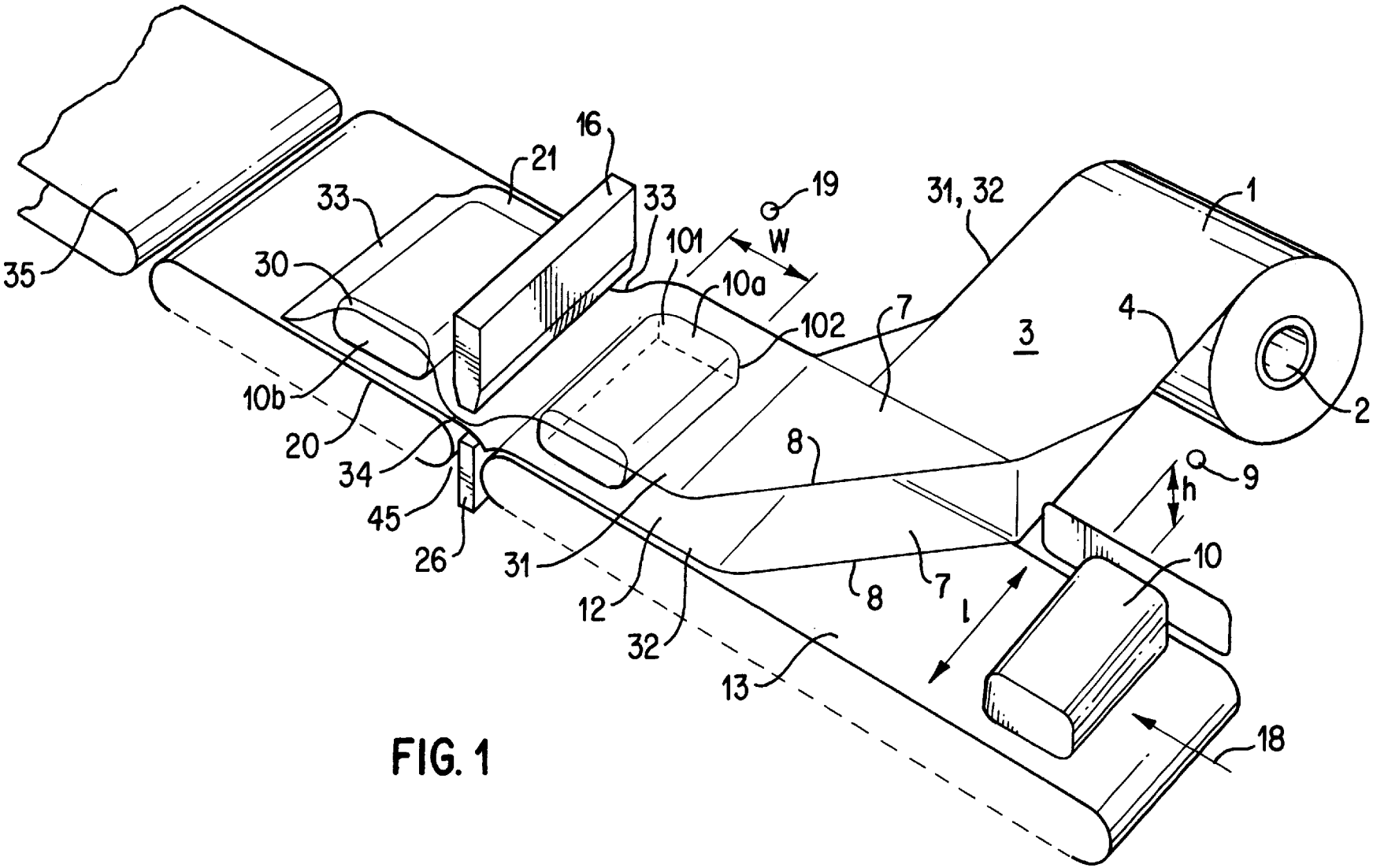
FIG. 1 is a perspective view of a packaging apparatus of the invention, represented in a schematic manner.

In FIG. 1 there is shown an automatic apparatus for packaging products by means of a film of thermoplastic material. The apparatus comprises a roller 1 provided with an axle 2 on which there is wound a center-folded film 3 of thermoplastic material; 4 is the longitudinal middle axis along which the film 3 is folded, and 31 and 32 are the two superimposed webs of the film. The width of the folded film is greater than the maximum length L of the products to be packaged.

Figure 2:
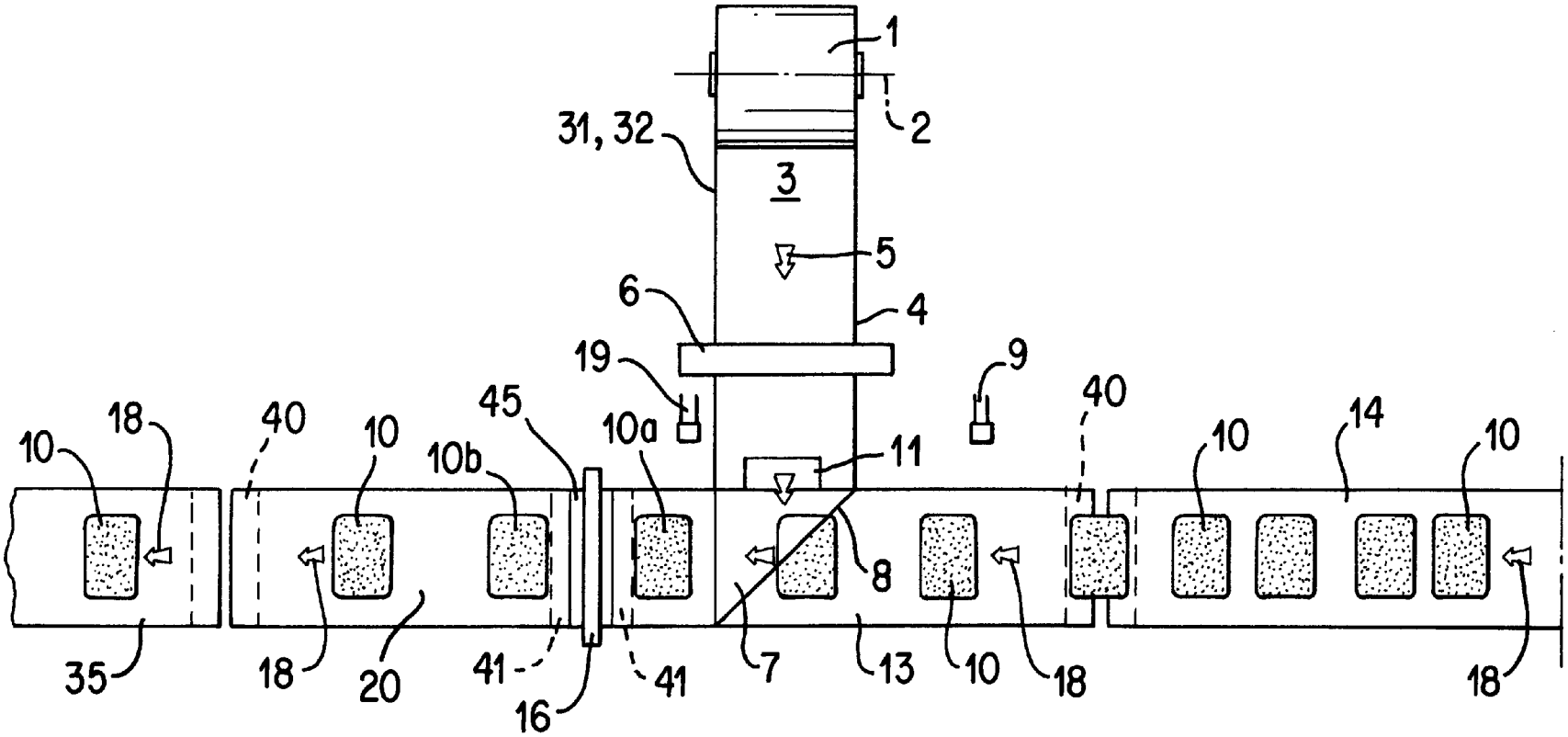
FIG. 2 is a plan view on a reduced scale of the apparatus of FIG. 1.

As shown in FIG. 2, the center-folded film 3 is unwound from the roller 1 and is made to advance in a direction orthogonal to the axle 2 (arrow 5) by a pair of rollers 6. The roller 1 can be mounted idle on the axle 2 or it can be driven in rotation so as to unwind the film. The center-folded film 3 is guided past a pair of plates ("inverting heads") 7, preferably substantially in the shape of triangles, whose respective edges 8 are inclined with respect to the direction 5 of forward motion of the film 3. The two triangular plates 7 are parallel and are placed at a vertical distance that can be adjusted manually or automatically, in relation to the height h of products 10 to be packaged, by means of e.g. a mechanical actuator, diagrammatically shown as block 11. The height of the products 10 can be detected by at least one sensor means 9, e.g. such as one or more photocells.

The two plates 7 shown in FIG. 1 are shaped as right-angled triangles having respective hypotenuses that are inclined at an angle of 45° with respect to the direction 5. Upon advance of the film past plates 7, the hypotenuses 8 cause webs 31 and 32 of the center-folded film 3 to be separated and folded over inwardly at 45°, causing the film to change its direction by 90° (compare arrows 18 and 5 of FIG. 2) and to lay down over a conveyor belt 13. By using, as inverting heads, triangular plates 7 having a shape different from that of a right-angled triangle, a change of the direction of the film of less or more than 90° can be obtained. The webs 31 and 32 of the center-folded film 3, when they fold themselves around the plates 7, form a recess 12 capable of receiving one of the products 10. Products 10 are fed on the belt 13 by the belt 14 that keeps them at a uniform distance one from the other, thus acting as a synchronizer. Optionally, together with products 10 on the belt 13 there can be fed conventional items such as, for instance, absorbing pads (to be used for absorbing drips in case of packaging of e.g. meat), labels, oxygen absorbing sachets, and the like.

In the preferred embodiment of FIG. 1, the two webs 31 and 32 of the center-folded film 3 straddle on the outer surfaces of the plates 7 and then fold inwardly around the edges 8 to form a recess 12.

Alternatively, the two webs 31 and 32 of the center-folded film 3 are made to advance between the two plates 7 and then fold outward over the edges 8. In such a case, however, the articles to be packaged should be loaded into the recess 12 from the opposite side and contamination of the inner sealing area might occur.

The conveyor belt 13 moves at a constant speed and causes the products 10 to move forward with a constant motion in the direction 18 along which there is at least one sensor means 19 that detects the width w of a product 10*a*. In this specific case the sensor means 19 is a photocell. The photocell 19 emits a first signal at the passage of a leading edge 101 of the product 10*a* and a second signal at the passage of a trailing edge 102 thereof. The signals of the photocell 19 are sent to an electronic control system, diagrammatically shown by a block 15 in FIG. 3, that commands the sealing of the center-folded film 3 along the transverse sides of the product 10*a* in a manner that will be described below. The belt 13 feeds product 10*a* to an adjacent conveyor belt 20 while, in the space 45 between the two belts 13 and 20, a sealing bar 16 seals the center-folded film 3. Belts 13 and 20 are formed by two spaced branches of a single endless belt, indicated as a whole with 22. The belts 13 and 20 are moved by a driving pulley 40 and are guided by idle pulleys 41 and 43. The pulleys 40 and 43 are supported by a fixed base, not shown, while the pulleys 41 are supported by a movable carriage 24.

Figure 3:
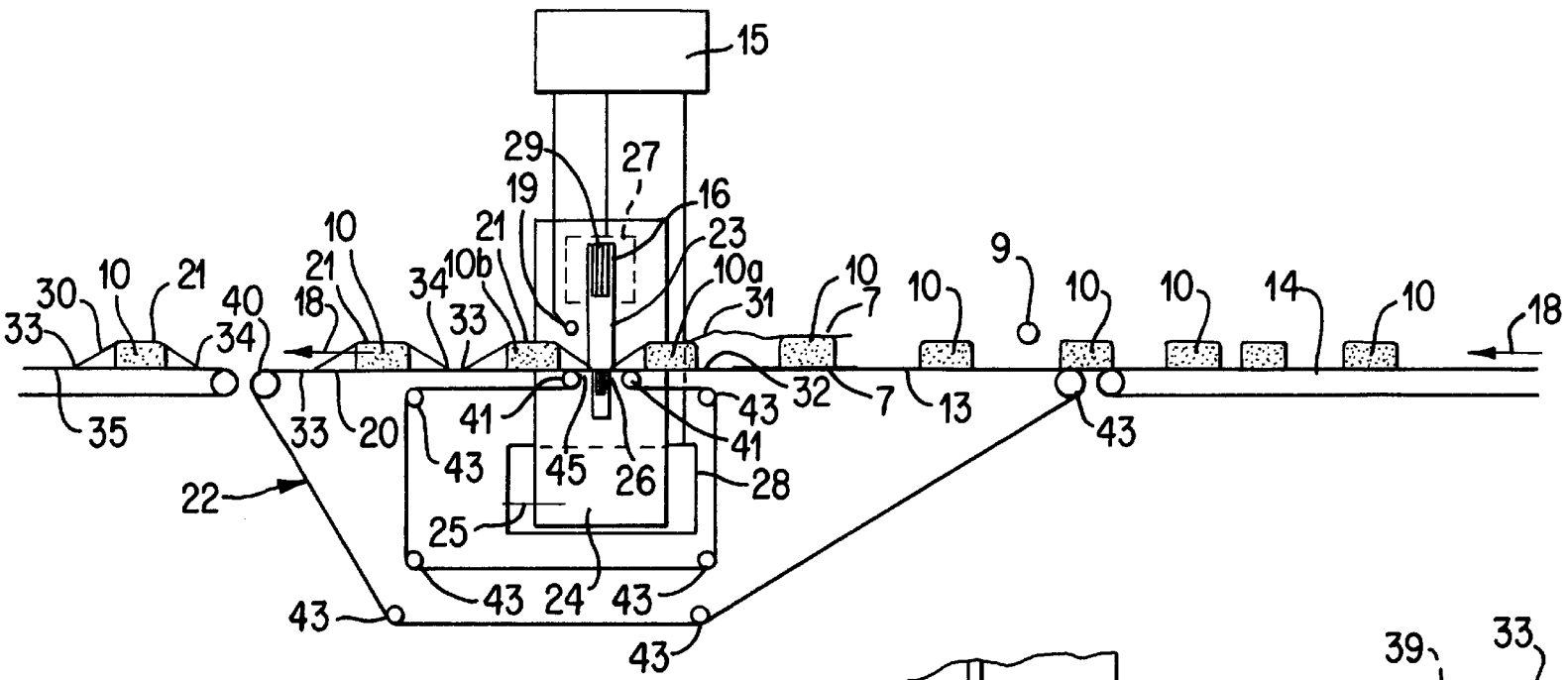
FIG. 3 is an elevational view of the apparatus of FIG. 2.

As shown in FIG. 3, the sealing bar 16 is slidably supported by a vertical slide 23 fastened to the movable carriage 24 and is operatively connected with actuators, diagrammatically shown by a block 27, that cause it to translate vertically along the slide 23 until it reaches the level of a fixed counterbar 26, integral with the carriage 24. For example, the actuators 27 may be formed by an electric motor and by a rack and pinion mechanism located inside the carriage 24. In turn, the carriage 24 is operatively connected with actuators, diagrammatically shown by a block 28, that are capable of making it translate in a direction parallel to the belts 13 and 20, in a double direction of translation, as indicated by the double arrow 25. For example, the actuators 28 can also comprise an electric motor and a rack and pinion mechanism. Both the actuators 27 and 28 are operatively connected to the control system 15 that operates them according to the signals emitted by the photocell 19.

Figure 4:
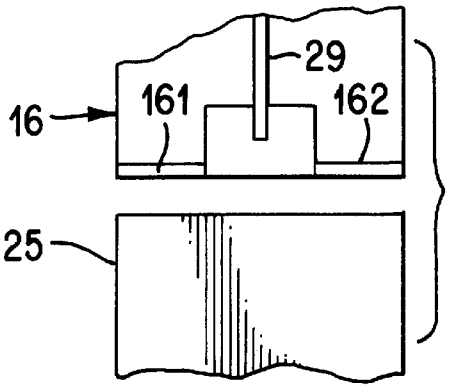
FIG. 4 is a partial enlarged view of a sealing bar and of a counterbar shown in FIG. 3.

As shown in FIG. 4, the sealing bar 16 is formed by two separate sealing portions, 161 and 162, between which a severing blade 29 is placed.

Figure 5:
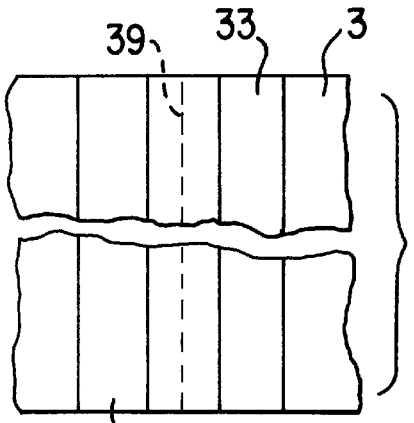
FIG. 5 is a partial plan view of seals of a film used in the apparatus of FIG. 1.

When the film 3, containing the product 10*a* in the recess 12, leaves the plates 7 and moves in the direction 18, the sealing cycle of a bag 21 starts. The bar 16, which is in the initial raised position, is driven by its actuators 27 to move vertically downward to an operative position, in contact with the center-folded film 3 on the left hand side of the product 10*a*. The bar 16 presses the center-folded film 3 against the counterbar 26 and pulls it in the direction indicated by arrow 18, being caused to move by the carriage 24, while it performs two transverse seals 33 and 34, as shown in FIG. 5. The carriage 24 is driven by its actuators 28 to translate horizontally (arrow 25) at the speed of the belts 13 and 20, causing movement of the bar 16, the counterbar 26 and the pulleys 41. In this operative condition, the bar 16 performs two transverse seals 33 and 34 by means of the two sealing portions 161 and 162 (FIGS. 4 and 5). The seals 33 and 34 close a bag 21 on the left hand side of the product 10*a* and a previous bag 21 on the right hand side of a product 10*b*, respectively. The bar 16 remains in contact with the film 3 for the time needed to perform the seals 33 and 34 while accomplishing a forward stroke whose amplitude depends on the preset sealing time and on the speed of translation of the carriage 24.

When seals 33 and 34 have been completed, blade 29, associated with the bar 16, is actuated, thus severing the film 3 transversally along a line 39 intermediate between the two seals 33 and 34, and separating the two seals. At this point, the bar 16 is driven by its actuators 27 to move away from the film 3 and to move vertically upward until it returns to the at rest position. Simultaneously, the carriage 24 is operated to translate backward, in a direction opposite to the movement of the belts 13 and 20, causing the bar 16 to perform a return stroke whose amplitude depends on the length of the product 10*a* detected by the photocell 19. In this way the carriage 24 takes the pulleys 41 and the bar 16 back to their original position, where the bar is ready to move downward again toward the film 3 to perform another two transversal seals 33 and 34 on the right hand side of the product 10*a*. The bar 16 moves downward after the arrival of the signal indicative of the edge 102 emitted by the photocell 19, coming into contact again with the film 3 and remaining in contact with it for another forward stroke. The bar 16 operates as described for the seals 33 and 34 on the left hand side of the product 10*a*, including the separation of the two seals 33 and 34. The actuators 27 and 28 of the bar 16 and of the carriage 24 are operated by the control system 15 depending on the signals coming from the photocell 19 so as to leave a constant distance between the edges 101 and 102 of the product 10*a* and the left and right transverse seals 33 and 34.

Once the seals 33 and 34 to the left and right of a product 10 have been completed and their severing has been performed, the bag 21 that encloses the product 10 is obtained, with the mouth 30 open. The bag 21 can be unloaded from the belt 20 to a conveyor belt 35 that, moving at a speed preferably higher than that of belt 20, keeps the bags 21 spaced and conveys them toward a sealing apparatus. For example, the sealing apparatus may be a sealing apparatus or a clipping apparatus capable of closing the open mouth 30 of the bag 21, after producing a vacuum, or in a normal or modified atmosphere.

Average sealing times of the packaging apparatus described above can vary from about 0.5 seconds to about 3 seconds, depending on the material and the thickness of the film 3. In a typical sealing cycle, the duration of the cycle is of 2.45 seconds and comprises the forward stroke of the bar 16 (1.75 seconds), the return stroke (0.55 seconds), inclusive of the time taken by the bar 16 to move down and up (0.5 seconds), and the waiting time (0.15 seconds). Hence, with this cycle, hourly production of up to 1,500 bags is possible in some cases.

In a still preferred embodiment of this invention the bag is vacuumized before sealing or clipping the open mouth closed. This step is typically performed by means of e.g. mono- or multi-product single vacuum/sealing chambers such as those manufactured by Transvac or by means of revolving vacuum/sealing chamber apparatuses such as those manufactured by Furukawa. Preferably these vacuum/sealing chambers will be provided with a system of conveyors capable of positioning the bag in such a way that sealing occurs as close as possible to the front side of the packaged product.

Typically, the amount of gas that is removed from the vacuum chamber during the vacuumization step is at least 80%, preferably at least 90% and even more preferably at least 95% by volume.

In another preferred embodiment of this invention, the center-folded film is a heat-shrinkable film and the vacuumized bag, after sealing or clipping, undergoes a heat-shrinking treatment to provide a tight-skinned package. This can be easily accomplished by providing a conveyor that receives a packaged product from a vacuum/sealing chamber and discharges the same into a heated shrink tunnel.

The films employed in this invention may be mono-layer or multi-layer.

Multi-layer films will be preferred whenever all of the required properties are not possessed by a single polymeric component or by a blend of polymers in a single layer, e.g., when gas barrier properties, sealability, abuse resistance, and the like are needed in a single film.

As described above, in a bag of this invention the sealing of the front side may be performed close to the front side of the packaged product so that there will result a surplus of film webs whenever the length L of the packaged product is shorter than the transverse length of the film webs. The above mentioned surplus may be severed. Alternatively, in the above mentioned surplus of film webs there can be made one or more holes or slits to be used for hanging or carrying the bag containing the packaged product.

One skilled in the art will appreciate that in the known packaging machines which form a package from a tubular film, the sealing and severing sequence is as follows: (i) sealing of the front side, (ii) sealing of only one transverse side, (iii) severing of both the transverse sides, and (iv) sealing of one transverse side. In contrast, the sequence of the present invention is (I) sealing and severing of both the transverse sides, and (II) sealing of the front side.

A preferred embodiment of this invention also comprises the step of vacuumizing the bag before sealing or clipping its open mouth (i.e., before step e) of the above described method of the present invention.

Even more preferably, a heat-shrinkable film is used, and the method thus also comprises an additional step of submitting the package to a heat-shrinking step to provide a tight-skinned package.

The present invention permits high packaging speeds because the center-folded film and the products are continuously advancing, and the transverse seals of the film are made along the two transverse sides of each single product while both film and product are in motion.

Furthermore, the apparatus of this invention automatically fits the width of each single bag to that of each single product. The means for forming a recess between the first and second film webs provides a recess whose height is proportional to the height of the product, and at least one sensor detects the width of the product, allowing automatically adjustment of the distance between the seals along the two transverse sides of the product, and, thus, the width of each bag.

Moreover, the apparatus can perform packaging operations under favorable conditions in that the recess can be formed by folding the two webs of the center-folded film inwardly. In this way, it is possible to load the products to be packaged into the recess, avoiding any contact of the mouth of the bag with the product, so that no deposit of grease or liquids is formed capable of hindering the subsequent sealing of the mouth of the bag. The foregoing description of preferred embodiments of the invention has been presented for purposes of illustration and description only. It is not intended to be exhaustive or to limit the invention to the precise forms disclosed, and modifications and variations are possible in view of the above teachings or may be acquired from practice of the invention.

What is claimed is:

1. An apparatus comprising:

(a) a roller on which a center-folded film is mounted, the center-folded film having a first web and a second web;

(b) means for guiding the two webs of said center-folded film and forming a recess capable of enclosing a product;

(c) means for advancing the film in a preselected direction while feeding a plurality of products into the recess between the film webs, the products spaced apart from each other, and the products having a first and second transverse side on the leading one trailing edges of the products;

(d) means for sealing the film along the two transverse sides of each product, said means movable vertically and horizontally, capable of producing a first and second transverse seal;

(e) at least one means for detecting the width of each product, and capable of emitting a first signal at the passage of a leading edge of each product and a second signal at the passage of a trailing edge of each product, said means for detecting being operatively connected to a means for controlling capable of operating an actuator of the means for sealing to leave a constant distance between the first and second transverse sides of each product and the first and second transverse seals; and (f) means for severing the film so as to form a plurality of bags with one open mouth on a front side of each bag, wherein each bag encloses a respective product.

2. The apparatus of claim 1 wherein the means for guiding comprises two plates, substantially in the shape of a triangle whose hypotenuse side is inclined with respect to a first direction of forward motion of the center-folded film, the plates capable of deflecting the center-folded film from the first direction of forward motion to a second direction of forward motion while keeping the film webs folded over inwardly, the two plates being substantially parallel and disposed at a vertical distance with respect to each other that can be adjusted in relation to the height of the products.

3. The apparatus of claim 2 wherein the two plates are each in the shape of a right triangle having respective hypotenuse sides inclined at an angle of 45° with respect to the first direction of forward motion of the center-folded film, the plates capable of deflecting the center-folded film by 90° from the first direction of forward motion to a second direction of forward motion.

4. The apparatus of claim 2, wherein the two plates are operatively connected to an actuator capable of adjusting their reciprocal distance.

5. The apparatus of claim 1 wherein said means for advancing comprises a conveyor system formed by a first belt and by a second belt that form two branches respectively on an endless belt.

6. The apparatus of claim 5 further comprising a third belt capable of delivering to the first belt a plurality of products while keeping them at a uniform distance one from the other.

7. The apparatus of claim 1 further comprising a means for moving each filled bag to a vacuum/sealing chamber where the bag is evacuated and the open mouth thereof is sealed or clipped.

8. The apparatus of claim 1 wherein the means for sealing is operatively connected to a first actuator capable of bringing and keeping the means for sealing in contact with the film in order to provide the transverse seals while the film is in motion.

9. The apparatus of claim 8 wherein the means for sealing is operatively connected to a first actuator capable of bringing and keeping the means for sealing in contact with the film for a pre-determined forward stroke in order to provide a first transverse seal on one side of each product and, at the end of the forward stroke, a pre-determined return stroke to go back to an initial position wherein the means for sealing are ready to provide a second transverse seal of the film on another side of each product.

10. The apparatus of claim 1 wherein the means for sealing is slidably supported by a vertical slide integral with a carriage that is movable in a preselected direction parallel to the means for advancing the film.

11. The apparatus of claim 10 wherein the means for sealing is operatively connected to a first actuator capable of moving the means for sealing vertically along the slide.

12. The apparatus of claim 10 wherein the carriage is operatively connected to a second actuator capable of moving the carriage in a direction parallel to the means for advancing the film.

13. The apparatus of claim 1 further comprising means for sealing or clipping the open mouth of each respective bag.

14. A method of packaging comprising:

(a) unwinding a center-folded film from a roller, the center-folded film having a first web and a second web;

(b) guiding the two webs of said center-folded film to form a recess between the first and second film webs;

(c) advancing the film in a preselected direction while feeding a plurality of products into the recess between the film webs, the products spaced apart from each other, and the products having a first and second transverse side (d) detecting the width of each product;

(e) emitting a first signal at the passage of a leading edge of each product and a second signal at the passage of a trailing edge of each product;

(f) providing a sealing means to produce transverse seals along the two transverse sides of each product;

(g) operating an actuator of said sealing means to leave a constant distance between the first and second transverse sides of each product and the first and second transverse seals;

(h) sealing the film along the two transverse sides of each product so as to form a plurality of bags with one open mouth on a front side of each bag, wherein each bag encloses a respective product; and (i) sealing or clipping each open bag mouth.

15. The method of claim 14 further comprising the steps of vacuumizing the bag before sealing or clipping its open mouth.

16. The method of claim 14 further comprising heat shrinking the bags around their respective products.

17. The method of claim 14 wherein the recess between the first and second film webs is formed by folding the first and second film webs around a pair of inverting heads.

* * * * *

UNITED STATES PATENT AND TRADEMARK OFFICE

CERTIFICATE OF CORRECTION

PATENT NO. : 5,941,052

DATED : August 24, 1999

INVENTOR(S) : Riccardo Evangelisti

It is certified that error appears in the above-identified patent and that said Letters Patent is hereby corrected as shown below:

Column 7, line 3 , delete "one", substituting therefor - - and - -.

Column 8, line 32, after the words "transverse side", insert - - on the leading and trailing edges of the products; - -.

Signed and Sealed this

Eighteenth Day of January, 2000

*Attest:*

*Attesting Officer*

Q. TODD DICKINSON

*Commissioner of Patents and Trademarks*